US009933235B1

(12) United States Patent
Beard et al.

(10) Patent No.: US 9,933,235 B1
(45) **Date of Patent: *Apr. 3, 2018**

(54) HOLSTER FOR A HANDGUN

(71) Applicant: N82 Tactical, Inc., Lexington, NC (US)

(72) Inventors: Nathan Beard, Lexington, NC (US); Nathan B. Johnson, Lexington, NC (US)

(73) Assignee: N82 Tactical, Inc., Lexington, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/447,740

(22) Filed: Mar. 2, 2017

Related U.S. Application Data

(63) Continuation of application No. 14/494,166, filed on Sep. 23, 2014, now Pat. No. 9,599,433, which is a continuation of application No. 12/946,405, filed on Nov. 15, 2010, now abandoned.

(60) Provisional application No. 61/261,392, filed on Nov. 16, 2009.

(51) Int. Cl.
*F41C 33/00* (2006.01)
*F41C 33/02* (2006.01)
*F41C 33/04* (2006.01)

(52) U.S. Cl.
CPC ..... *F41C 33/0236* (2013.01); *F41C 33/02* (2013.01); *F41C 33/0209* (2013.01); *F41C 33/0263* (2013.01); *F41C 33/041* (2013.01); *F41C 33/048* (2013.01)

(58) Field of Classification Search
CPC .... F41C 33/02; F41C 33/0236; F41C 33/041; F41C 33/0209; F41C 33/048; F41C 33/0263
USPC ..... 224/587, 193, 198, 238, 269, 578, 666, 224/911, 912
See application file for complete search history.

(56) References Cited

U.S. PATENT DOCUMENTS

| | | | | | |
|---|---|---|---|---|---|
| 2,434,380 | A | | 1/1948 | Williams | 224/243 |
| 2,576,231 | A | | 11/1951 | Lawson, Jr. et al. | 224/2 |
| 3,289,903 | A | | 12/1966 | Taormian | 224/2 |
| 3,583,612 | A | * | 6/1971 | Theodore | F41C 33/0227 224/243 |
| 3,731,858 | A | | 5/1973 | Baker | 224/2 B |
| 3,942,692 | A | | 3/1976 | Chica | 224/2 B |
| 4,022,361 | A | | 5/1977 | Devlin | 224/2 B |
| 4,062,481 | A | | 12/1977 | Clark | 224/2 B |
| 4,165,826 | A | * | 8/1979 | Chica | F41C 33/0209 224/191 |
| 4,667,374 | A | | 5/1987 | Bianchi | 24/3.9 |
| 4,718,585 | A | * | 1/1988 | Atkins, Sr. | F41C 33/0227 224/238 |
| 4,785,983 | A | | 11/1988 | DeSantis | 224/206 |
| 4,787,540 | A | | 11/1988 | Barry | 224/193 |
| 4,898,310 | A | | 2/1990 | Remington | 224/238 |
| 5,054,671 | A | | 10/1991 | Else | 224/192 |
| 5,265,781 | A | | 11/1993 | Nichols | 224/198 |

(Continued)

*Primary Examiner* — Adam Waggenspack
*Assistant Examiner* — Lester L Vanterpool
(74) *Attorney, Agent, or Firm* — MacCord Mason PLLC

(57) ABSTRACT

A holster for carrying a handgun inside a wearer's beltline is shown and described. In one embodiment, the holster includes a body-interface surface (BIS) having a body side (BS) and a gun side (GS). An elastic strap may be interfaced with the gun side of the body-interface surface. A clip may be interfaced with the elastic strap. Other embodiments include methods of making a holster and methods of carrying a handgun.

20 Claims, 7 Drawing Sheets

(56) References Cited

U.S. PATENT DOCUMENTS

| | | | | |
|---|---|---|---|---|
| 5,419,474 | A | 5/1995 | Marx et al. | 224/244 |
| 5,445,303 | A | 8/1995 | Cawile, Jr. | 224/222 |
| 5,570,827 | A | 11/1996 | Wiesner | 224/587 |
| 5,816,459 | A | 10/1998 | Armistead | 224/246 |
| 6,050,465 | A | 4/2000 | Nelson et al. | 224/243 |
| 6,089,432 | A | 7/2000 | Gage et al. | 224/587 |
| 6,092,703 | A | 7/2000 | Johnson | 224/198 |
| 6,264,079 | B1 | 7/2001 | Skaggs | 224/193 |
| 6,398,089 | B1 | 6/2002 | Har-Shen | 224/192 |
| 6,574,997 | B1 | 6/2003 | Mayer et al. | 68/23.1 |
| 6,685,066 | B2 | 2/2004 | Cragg | 224/192 |
| 6,691,906 | B2 | 2/2004 | Cragg | 224/238 |
| 6,763,984 | B2 * | 7/2004 | Gallagher | A45F 5/02 224/193 |
| 6,814,270 | B2 | 11/2004 | Mason | 224/587 |
| 7,258,259 | B1 | 8/2007 | Owens | 224/193 |
| 7,314,152 | B1 | 1/2008 | Garrett | 224/192 |
| D620,705 | S | 8/2010 | Beard et al. | D3/222 |
| 8,672,201 | B2 | 3/2014 | Craighead | 224/587 |
| 2006/0219743 | A1 * | 10/2006 | Gallagher | A45F 5/02 224/192 |
| 2007/0138188 | A1 | 6/2007 | Mace et al. | 220/739 |
| 2010/0108728 | A1 * | 5/2010 | Castaneda | F41C 33/0209 224/243 |
| 2010/0181835 | A1 | 7/2010 | Craighead | 224/193 |
| 2010/0270349 | A1 | 10/2010 | Craighead | 224/587 |

* cited by examiner

HOLSTER FOR A HANDGUN

RELATED APPLICATIONS

This application is a continuation of U.S. patent application Ser. No. 14/494,166 filed Sep. 23, 2014, which is a continuation of application Ser. No. 12/946,405 filed Nov. 15, 2010, now abandoned, which claims the benefit of U.S. Patent Application No. 61/261,392 filed Nov. 16, 2009.

FIELD OF TECHNOLOGY

The inventions of the present disclosure relate generally to gun holsters and more particularly to holsters designed to carry a handgun inside the waistline.

BACKGROUND

Holsters are known in the art. Most commonly they are designed for carrying guns externally, e.g., as seen in FIG. 1. In many situations, however, external carry is not ideal. For example, for concealed carry, for backup carry, for off-duty police officers, for intelligence organizations, for military Special Forces, etc., it may be desirable to carry the handgun inside the waistline.

Others have attempted to develop carrying systems for carrying handguns inside the waistline with little success. It is to these and additional problems that the inventions of the present disclosure are addressed.

SUMMARY

The inventions of the current disclosure, are directed to, inter alia, holsters, methods of making holsters, and methods of carrying guns.

In one embodiment, a holster comprises a body-interface-surface (BIS) having a body-side (BS) and a gun-side (GS). An elastic strap is interfaced with the BIS. A clip is interfaced with the elastic strap.

In another embodiment, a method of forming a holster comprises sandwiching at least three layers together to form a BIS. An elastic strap is attached to the BIS. A clip is attached to the elastic strap.

Methods also include methods of carrying a handgun by placing the handgun in any holster as described herein and placing that holster inside the waistline.

The above summary was intended to summarize certain embodiments of the inventions of the present disclosure. Embodiments will be set forth in more detail in the figures and detailed description below. It will be apparent, however, that the detailed description is not intended to limit the present invention, the scope of which should be properly determined by the appended claims.

DETAILED DESCRIPTION OF TYPICAL EMBODIMENTS

Figure 1:
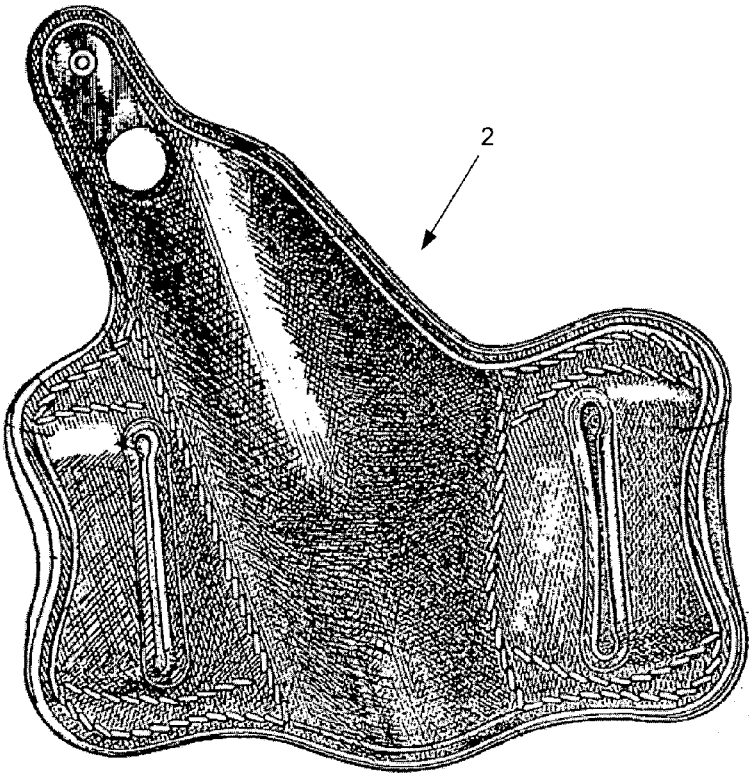
FIG. 1 shows a known holster.
Figure 2:
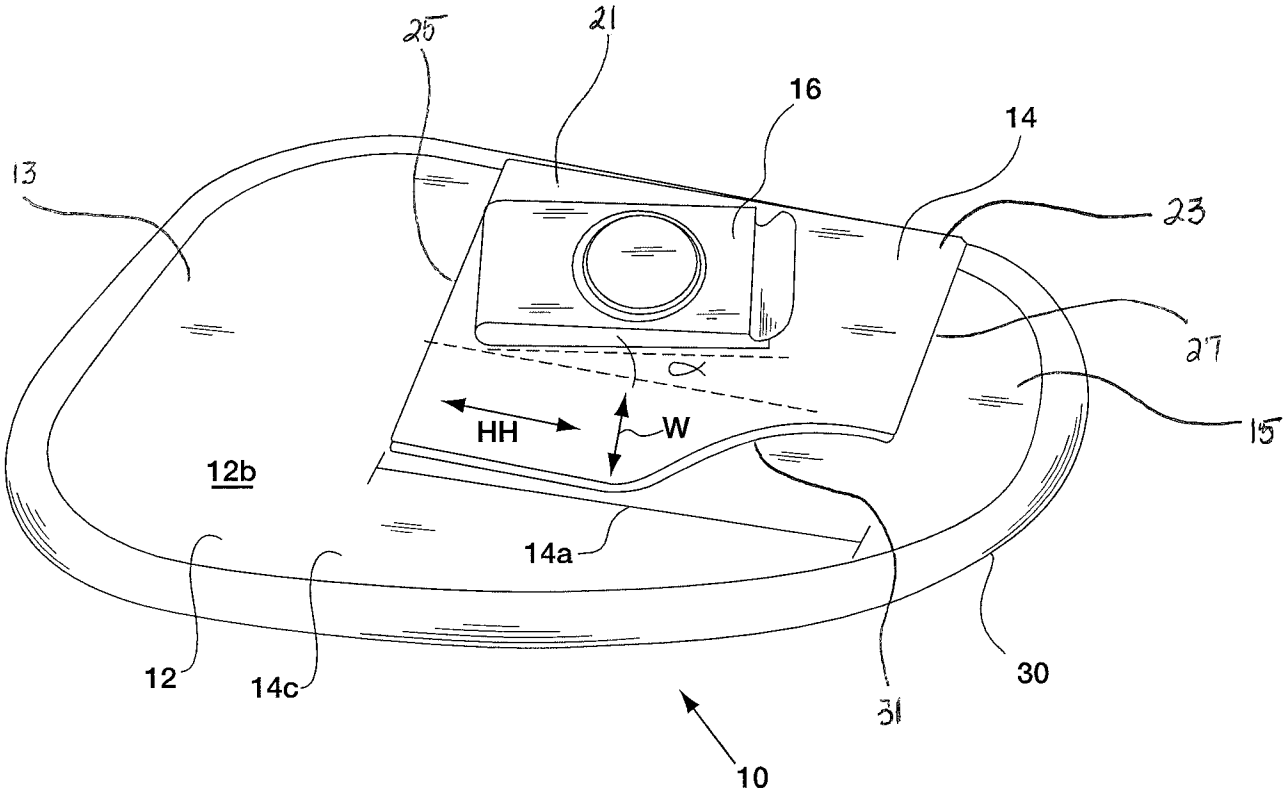
FIG. 2 shows one embodiment of the invention.
Figure 3:
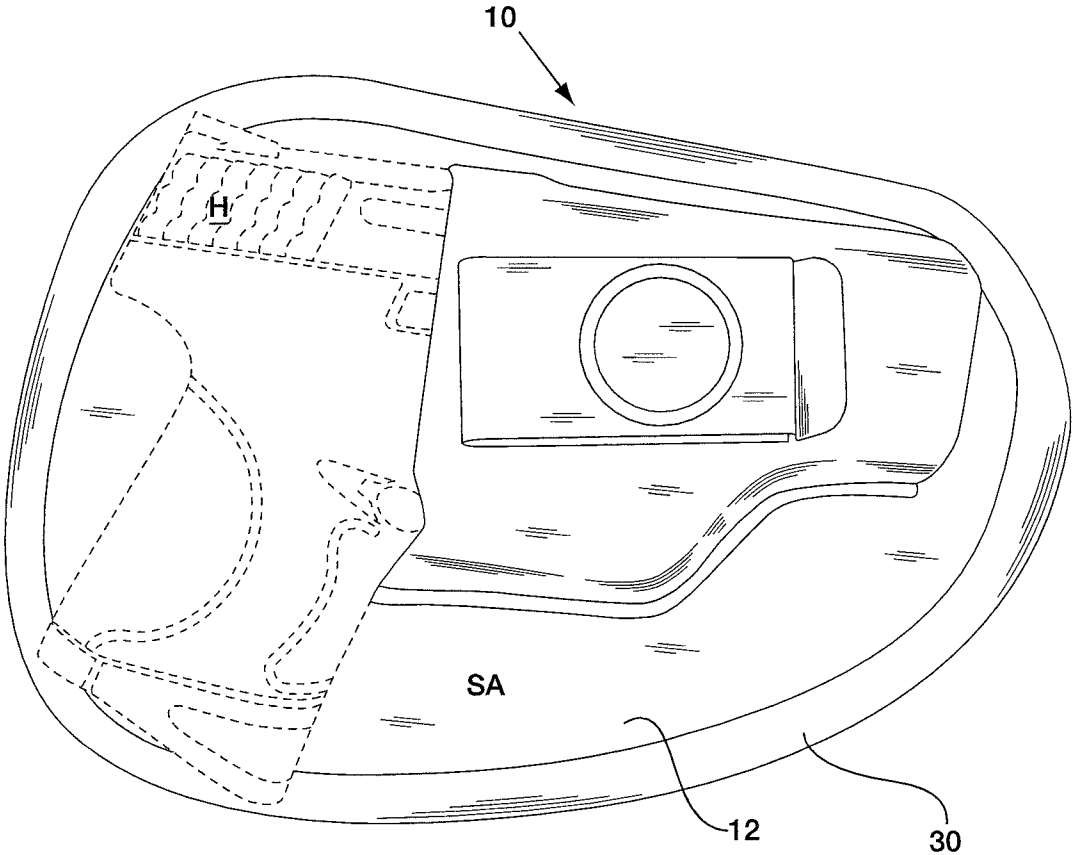
FIG. 3 shows the embodiment of FIG. 2 holding a gun.
Figure 4:
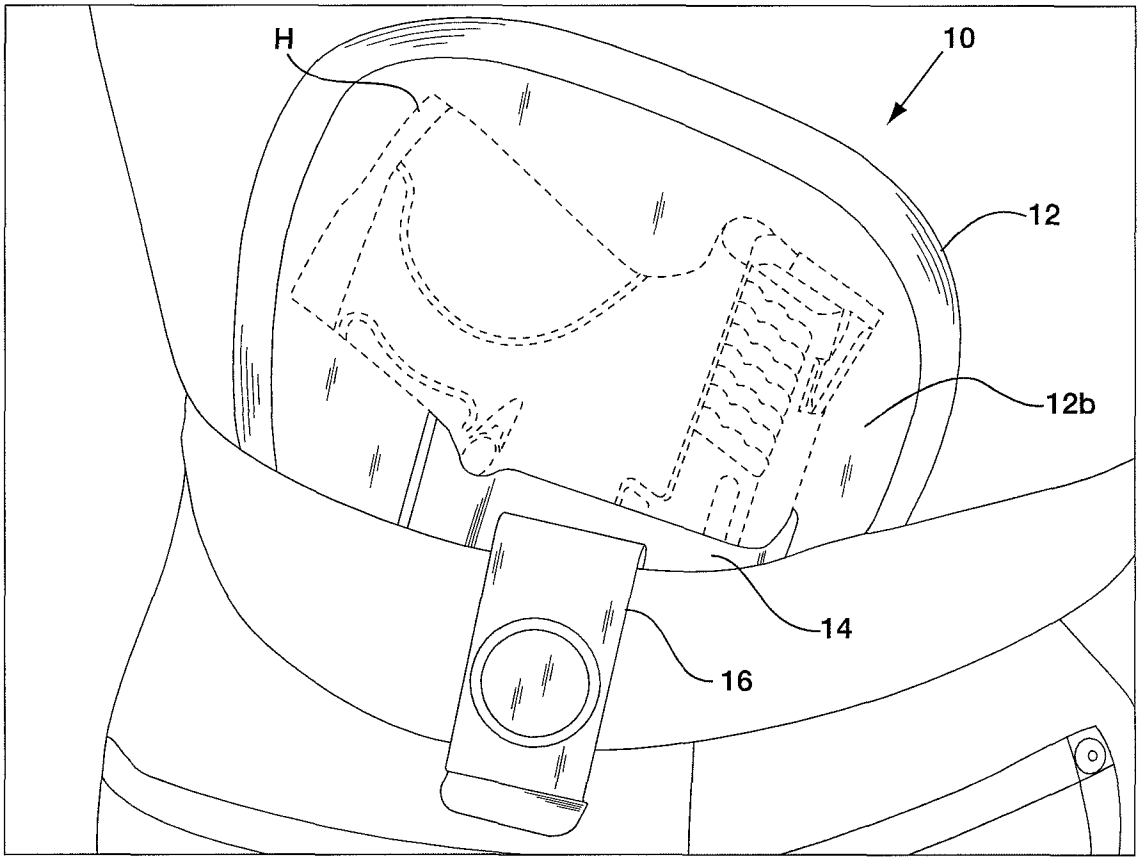
FIG. 4 shows the embodiment of FIG. 2 on a wearer.
Figure 5:
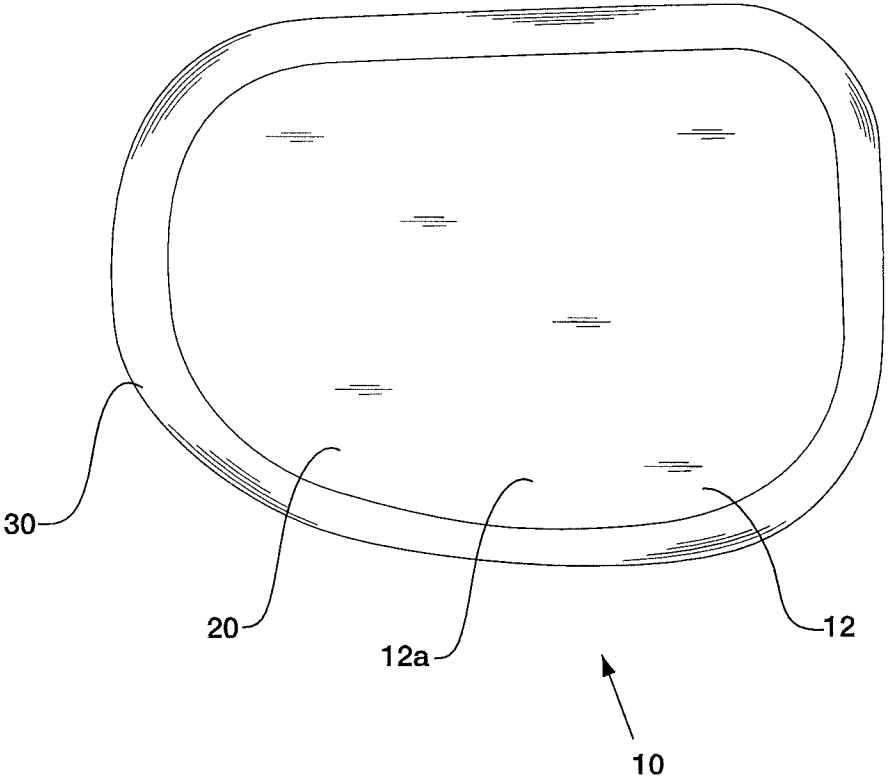
FIG. 5 shows the back side of the embodiment of FIG. 2.
Figure 6:
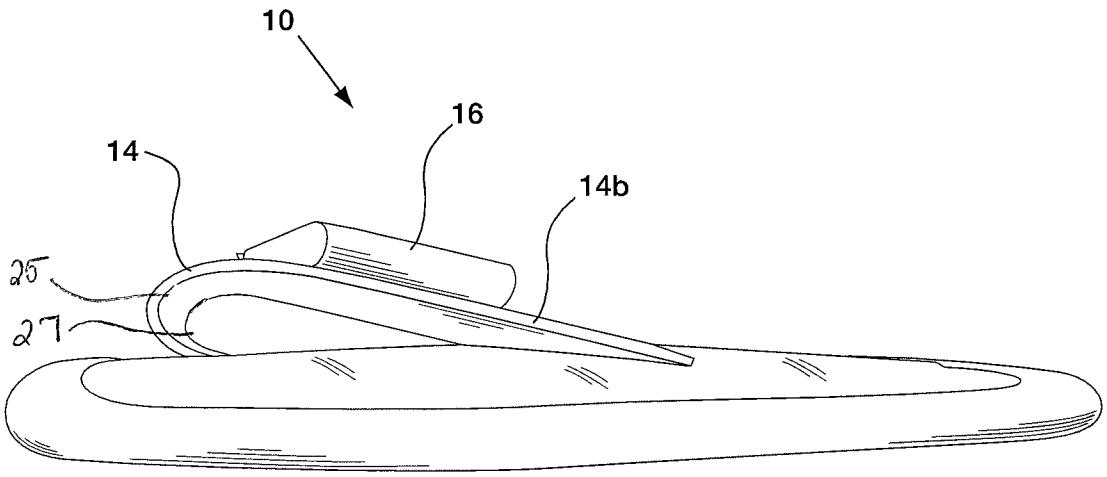
FIG. 6 shows a top view of the embodiment of FIG. 2.
Figure 7:
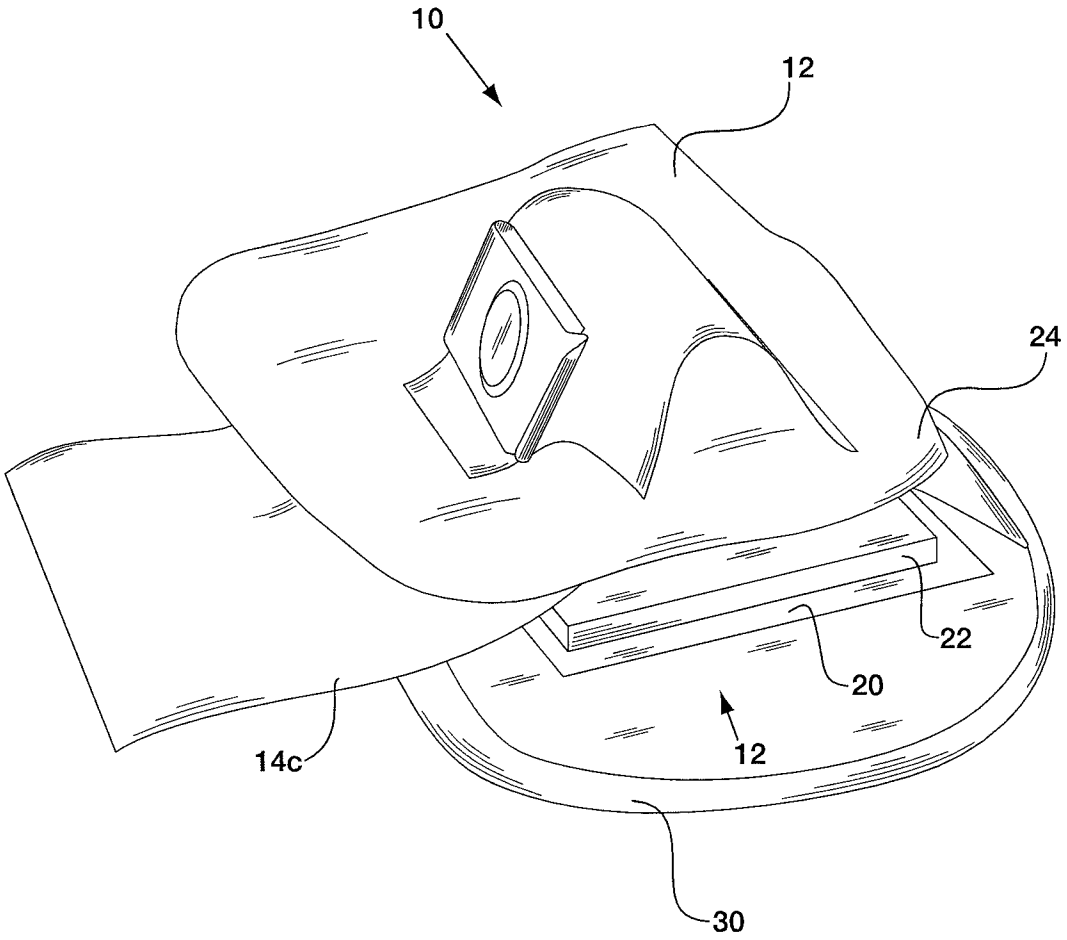
FIG. 7 shows an exploded view of the embodiment of FIG. 2.

FIG. 2 shows one embodiment of a holster of the invention. FIG. 3 shows the holster of FIG. 2 holding a gun. FIG. 4 shows the embodiment of FIG. 2 on a wearer. FIG. 5 shows the back side of the embodiment of FIG. 2. FIG. 6 shows a top view of the embodiment of FIG. 2. FIG. 7 shows an exploded view of the embodiment of FIG. 2.

Referring generally to FIGS. 2, 3, 4, 5, 6, and 7, holster 10 includes a body-interface-surface (BIS) 12, an elastic strap 14 and a clip 16.

BISs may vary from embodiment to embodiment, but typically include body-side (BS) 12*a* and a gun-side (GS) 12*b*. BSs are configured to face the wearer's body, while GSs are configured to face the gun. The BIS may include a body-interface top 13 and a body-interface bottom 15.

BISs have a flexibility sufficient to mold to the wearer's body, for example as seen in FIG. 4. The BIS may mold around the hip, the rear of the hip, the front of the hip, the small of the back, the front of the waist, etc. A variety of materials may have sufficient flexibility to achieve the desired mold. As illustrated in FIG. 3, BIS 12 has a surface area SA larger than the side profile of the handgun H (more on the function of the surface area below) and sufficient to form a barrier between the handgun H and a wearer.

As seen in the exploded view of holster 10 (FIG. 7), BIS 12 includes BS-layer 20, GS-layer 24, and compression layer 22 positioned between BS-layer 20 and GS-layer 24. In typical embodiments, BS-layers have a thickness of about 0.5 to about 3.0 mm, more typically about 1.2 mm. GS-layers have a thickness of about 0.5 to about 3.0 mm, more typically about 1.4 mm. Compression layers has a thickness of about 0.5 to about 3.0 mm, more typically about 2 mm. Thickness of the layers, and overall thickness of the BIS contributes to the ability of the current holster to all for carrying inside the waist band.

Typically, the BS-layer includes leather, more typically, leather having a suede finish. Applicants have discovered that in the particular configuration and construction of holsters of the invention, the coefficient of friction of suede against the body, e.g., a wearer's skin or clothing is sufficient to greatly contribute to the overall stability of the platform. Materials having similar coefficients of friction are also considered suitable. Typically, the GS-layer includes leather, but other materials may be suitable.

In most embodiments, the GS of the BIS is substantially, e.g., greater than 50%, or entirely, e.g., greater than 90%, formed by the GS-layer. Somewhat similarly, in most embodiments, the BS of the BIS is substantially, e.g., greater than 50%, or entirely, e.g., greater than 90%, formed by the BS-layer. As seen for example in FIG. 5, BS-layer 20 covers the complete BS 12*a* to selvedge 30, thereby creating a smooth uniform surface.

Referring back to FIG. 7, compression layer 20 is visible. In typical embodiments, compression layer 20 is formed from neoprene, e.g., about 2 mm thick and backed on each side with nylon. Varying from embodiment to embodiment, compression layers typically have a surface area of at least 60%, at least 65%, at least 70%, at least 75%, at least 80%, at least 85%, at least 90%, at least 95%, and at least 99% of the side profile of the handgun. Somewhat similarly, compression layers have a surface area of at least 60%, at least 65%, at least 70%, at least 75%, at least 80%, at least 85%, at least 90%, at least 95%, and at least 99% of the BS-layer. Even more typically, compression layers will cover the complete BIS, e.g. to the selvedge.

Compression layers typically provide at least two functions. For example, they cushion the user from the gun to allow for comfortable carrying. Additionally, they allow the gun's shape to define a compression with the BIS, thereby increasing the holster's purchase on the gun and stability while being carried.

Materials used in construction of the BIS may vary from embodiment to embodiment, so long as desired function is maintained.

As seen in FIG. 2, holsters also include an elastic strap, e.g., strap 14. Strap 14 is typically interfaced with the GS of the BIS. Elastic straps typically have a height 14*a* sufficient to cover at least one of ¼, ⅓, or ½ of the height of the side profile of the handgun. As seen in FIG. 6, strap 14 forms a loop sized to receive a handgun. A portion of the loop extends externally 14*b* from the BIS and another portion of the loop 14*c* is positioned within the BIS (as illustrated in the exploded view and FIG. 2). The elastic strap 14 may have a first elastic portion 21 and a second elastic portion 23. The first elastic portion 21 may be wider than the second elastic portion 23. The first elastic portion may narrow, as seen in FIG. 2, from an open top 25 of the elastic strap to an open bottom 27 of the elastic strap. One side of the elastic strap 14 may be substantially parallel to at least one side of the outer peripheral edge of the BIS. An opposite side of the strap 14 may be non-parallel to the opposite peripheral edge. At least one side of the elastic strap 14 may have a curvature 31 that narrows the elastic strap between the open top 25 and the open bottom 27.

During construction, the tag portion of the elastic strap, e.g., 14*c* may extend across the side of the BIS some distance, e.g to the edge. In most embodiments, elastic strap 14 is constructed and positioned to have at least 20% stretch in the direction of the width W of the holster and less that 20% stretch in the direction of the height of the holster HH; applicants have surprisingly found that such a construction contributes to the improved stability and purchase of the holster.

Clip 16 may be interfaced with the elastic strap. Any clip having a size and rigidity suitable for affixing a holster as described herein inside of a wearer's pants should be sufficient. In some embodiments, the angle $\alpha$ of the clip's positioning may be adjusted to facilitate the carrying of the holster in different positions, typical a angles will be chosen from about 0 to about 30 degrees.

The above described holster allows for the secure and stable carrying of a handgun inside a wearer's waistline. It allows for surprisingly discrete, comfortable, and stable carry due to the construction of the holster. Further, holsters of the invention allow for improved access to the handgun because applicants' holsters allow for guns to be carried without the need for a latch or snap on the holster. Others will no doubt observe other advantages.

Inventions also include methods of forming a holster for carrying a handgun inside a wearer's beltline. In typical embodiments, a method comprises sandwiching at least three layers together to form a BIS; attaching an elastic strap to the BIS; and attaching a clip to the elastic strap. The at least three layers, the BIS, the elastic strap, and the clip can be any of those described above. Methods typically include attaching selvedge to the edge of the three layers, e.g., to secure the sandwich structure. The elastic strap is also typically attached by forming a loop though the GS-layer of the BIS.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

What is claimed is:

1. A holster for carrying a handgun inside a wearer's beltline, the holster comprising:

a body-interface surface having a height with a body-interface top toward an upper portion of the height and a body-interface bottom toward a lower portion of the height, a width, and outer peripheral edges along the height of the holster, wherein the height of the holster is greater than the width, the body interface surface including:

a body-side forming a first layer of the body-interface surface and having a user contact surface facing the wearer, a gun-side forming a second layer of the body-interface surface and having a gun contact surface facing away from the wearer, and an edge enclosing the first layer and the second layer, an elastic strap extending along the width of the body-interface surface to form a loop between the outer peripheral edges, the strap having an open top and an open bottom, a first tag end and a second tag end, wherein an exterior portion of the strap extends externally away from the first layer of the body-interface surface to form the loop and the first and second tag ends are secured to the body-interface surface, the elastic strap having a first elastic portion and a second elastic portion, wherein the first elastic portion is wider than the second elastic portion and the first elastic portion narrows from the open top to the open bottom, forming a smaller opening in the open bottom than the open top, and a handgun compression cavity formed between an interior of the loop and the gun-side of the body-interface surface, the handgun compression cavity adapted to accept and secure a holstered handgun in place, wherein the holster is adapted to fit inside the wearer's garment at the beltline and the body-interface surface has a surface area larger than the side profile of the handgun when holstered in the compression cavity such that the body-interface surface creates a barrier between the wearer and a holstered handgun.

2. The holster of claim 1 including a clip interfaced with the elastic strap.

3. The holster of claim 2 wherein the clip is attached to the elastic strap on an exterior side of the loop.

4. The holster of claim 3 wherein the clip includes a backside and a front side, wherein the backside fits within the waistline of the garment of the wearer and the front side secures the holster from outside the waistline of the garment of the wearer.

5. The holster of claim 2, wherein the clip is positioned with an angle alpha chosen from about 0 to about 30 degrees so that a top of the clip is non-parallel with the open top.

6. The holster of claim 2 wherein the body-interface surface has a flexibility sufficient to mold to the wearer's body.

7. The holster of claim 6 wherein the body side is set apart from contact with the handgun by the second layer.

8. The holster of claim 7, wherein the body side layer includes leather.

9. The holster of claim 8, wherein the gun side layer includes leather.

10. The holster of claim 1 including a third layer positioned between the first layer and the second layer.

11. The holster of claim 10, wherein the third layer is a compression layer.

12. The holster of claim 11, wherein the compression layer is waterproof.

13. The holster of claim 12, wherein the compression layer is neoprene.

14. The holster of claim 13, wherein the neoprene is backed on at least one side with nylon.

15. The holster of claim 1, wherein the elastic strap is constructed and positioned to have at least 20% stretch in the direction of the width of the holster and less than 20% stretch in the direction of the height of the holster.

16. The holster of claim 15, wherein the gun contact surface of the gun-side is more rigid than the interior side of the loop.

17. The holster of claim 1, wherein the handgun compression cavity is adapted to accept the handgun at a straight drop and the holster is adapted to secure the handgun at a cant.

18. A holster for carrying a handgun inside a wearer's beltline, the holster comprising:

a semi-rigid back including:

a height and a width, the height being greater than the width, a first and a second peripheral edge along the height of the rigid back, a body side with a wearer contact surface, a gun side with a gun contact surface, a non-rigid receiver extending from and secured to the semi-rigid back, including:

an open top forming an opening in the non-rigid receiver, the opening being perpendicular to at least one of the peripheral edges, an open bottom forming a second opening in the non-rigid receiver, the non-rigid receiver narrowing from the open top to the open bottom such that the second opening is smaller than the first opening, an interior and an exterior, a sight receiver side, a trigger receiver side, wherein the non-rigid receiver is constructed and positioned to have at least 20% stretch in the direction of the width of the rigid back and less than 20% stretch in the direction of the height of the rigid back, a rigid clip attached to the holster, and a compression cavity formed by the semi-rigid back and the interior of the non-rigid receiver, the compression cavity adapted to receive and secure the handgun to the holster.

19. The holster of claim 18 wherein the sight receiver side of the non-rigid receiver is parallel to the closest peripheral edge of the semi-rigid back, so that the receiver is adapted to accept a portion of the barrel of the handgun and secure it in a parallel plane to the closest outer peripheral edge.

20. A method of forming a holster for carrying a handgun inside a wearer's beltline, the method comprising:

combining a first layer and a second layer together to form a body-interface surface having outer peripheral edges along a height;

securing the first layer and the second layer together with an edge;

attaching an elastic strap to the body-interface surface;

creating a top opening in the elastic strap and a bottom opening in the elastic strap;

narrowing the elastic strap from the top opening to the bottom opening;

forming a loop with the strap, the strap having an internal portion and an external portion;

inserting the internal portion of the strap into the body-interface surface;

attaching a clip to the elastic strap, and attaching a selvedge to the edge.

* * * * *